US011078551B2

(12) United States Patent
Kim et al.

(10) Patent No.: US 11,078,551 B2
(45) Date of Patent: Aug. 3, 2021

(54) THREE-DIMENSIONAL COOLING TYPE HOT-STAMPING METHOD AND SYSTEM AND VEHICLE STRUCTURAL MEMBER MANUFACTURED BY THE SAME

(71) Applicants: Hyundai Motor Company, Seoul (KR); Kia Motors Corporation, Seoul (KR); Sungwoo Hitech Co., Ltd., Busan (KR)

(72) Inventors: Hyun-Gyung Kim, Hwaseong-Si (KR); Dong-Eun Cha, Seongnam-si (KR); Jin-Young Yoon, Gimpo-si (KR); Dae-Jung Kim, Suwon-si (KR)

(73) Assignees: Hyundai Motor Company, Seoul (KR); Kia Motors Corporation, Seoul (KR); Sungwoo Hitech Co., Ltd., Busan (KR)

( * ) Notice: Subject to any disclaimer, the term of this patent is extended or adjusted under 35 U.S.C. 154(b) by 256 days.

(21) Appl. No.: 15/808,612

(22) Filed: Nov. 9, 2017

(65) Prior Publication Data

US 2018/0171423 A1 Jun. 21, 2018

(30) Foreign Application Priority Data

Dec. 15, 2016 (KR) ..... 10-2016-0171422

(51) Int. Cl.
*C21D 1/673* (2006.01)
*C21D 11/00* (2006.01)
(Continued)

(52) U.S. Cl.
CPC ..... *C21D 1/673* (2013.01); *B21D 22/022* (2013.01); *C21D 9/46* (2013.01); *C21D 11/005* (2013.01)

(58) Field of Classification Search
None
See application file for complete search history.

(56) References Cited

U.S. PATENT DOCUMENTS

2003/0090032 A1* 5/2003 Sundgren ..... C21D 1/673 264/237
2004/0113461 A1 6/2004 Shimizu et al.
(Continued)

FOREIGN PATENT DOCUMENTS

EP 1755801 B1 4/2011
JP 2006-322065 A 11/2006
(Continued)

OTHER PUBLICATIONS

KIPO machine translation of KR10-2012-0102313 (Year: 2019).*

*Primary Examiner* — Stefanie J Cohen
*Assistant Examiner* — Christopher D. Moody
(74) *Attorney, Agent, or Firm* — Morgan, Lewis & Bockius LLP

(57) ABSTRACT

A hot-stamping method may include a three-dimensional cooling mode in which, when a closed-section product placed in an upper mold and a lower mold that are coupled each other is heat-treated under control of a controller, an external cooling water direct spraying operation of directly spraying cooling water onto an external portion of the closed-section product is performed and, simultaneously, an internal cooling water direct spraying operation of directly spraying cooling water into an internal of the closed-section product is performed.

7 Claims, 8 Drawing Sheets

(51) Int. Cl.
*B21D 22/02* (2006.01)
*C21D 9/46* (2006.01)

(56) References Cited

U.S. PATENT DOCUMENTS

| | | | | |
|---|---|---|---|---|
| 2008/0295563 | A1* | 12/2008 | Terziakin | B21D 22/02 72/364 |
| 2014/0096583 | A1* | 4/2014 | Cho | B21D 22/208 72/332 |
| 2014/0352388 | A1* | 12/2014 | Balint | C21D 1/62 72/342.5 |
| 2016/0107222 | A1* | 4/2016 | Kim | B21C 37/02 420/8 |
| 2016/0318086 | A1* | 11/2016 | Kang | B21D 22/022 |
| 2017/0048931 | A1* | 2/2017 | Ueno | B21D 26/039 |
| 2017/0066028 | A1* | 3/2017 | Ishizuka | B21D 26/039 |
| 2017/0145528 | A1* | 5/2017 | Cola, Jr. | C22C 38/38 |
| 2018/0148807 | A1* | 5/2018 | Richardson | B21D 22/208 |
| 2018/0162205 | A1* | 6/2018 | Jung | B21D 22/20 |
| 2019/0100816 | A1* | 4/2019 | Seki | B21D 22/022 |

FOREIGN PATENT DOCUMENTS

| | | | |
|---|---|---|---|
| JP | 2015-221445 | A | 12/2015 |
| KR | 2011-0008858 | A | 1/2011 |
| KR | 2011-0035699 | A | 4/2011 |
| KR | 10-2012-0102313 | A | 9/2012 |
| WO | WO 2005/110638 | | 11/2005 |

* cited by examiner

THREE-DIMENSIONAL COOLING TYPE HOT-STAMPING METHOD AND SYSTEM AND VEHICLE STRUCTURAL MEMBER MANUFACTURED BY THE SAME

CROSS-REFERENCE(S) TO RELATED APPLICATIONS

The present application claims priority to Korean Patent Application No. 10-2016-0171422, filed on Dec. 15, 2016, the entire contents of which is incorporated herein for all purposes by this reference.

BACKGROUND OF THE INVENTION

Field of the Invention

The present invention relates to a hot-stamping method; and, particularly, to a three-dimensional cooling type hot-stamping method and system which can cool the internal and external surfaces of a closed-section product, and a vehicle structural member manufactured by the same.

Description of Related Art

Generally, in a hot-stamping method, in the case of a product having an open section structure, cooling water (or quenching water) can be uniformly sprayed onto the entirety of the surface of the product, whereby the strength of the material of the product can be uniformly enhanced. In the present regard, the spray of cooling water is performed for quenching treatment by which the surface of the product is hardened wherein abrasion resistance and mechanical characteristics (particularly, fatigue resistance) can be enhanced.

Therefore, when the hot-stamping method is applied to the manufacture of a structural member and an impact absorption member for vehicles, the structural member or the impact absorption member can be easily manufactured by forming a plurality of products into a single product having uniform strength suitable for vehicles.

However, in the hot-stamping method, only when the cross-section of the structural member is similar to that of a plate can the uniform cooling effect by spraying cooling water be obtained. That is, the application of the conventional hot-stamping method is limited to a vehicle structural member having an open section.

For example, in the spray of cooling water for a structural member having a circular section, there is no alternative but to only the external surface of the structural member to be cooled.

Moreover, in the case of a structural member having a closed section, cooling water cannot be sprayed into the structural member, whereby uniform cooling effect cannot be achieved. The present problem of an uneven cooling effect is exacerbated in complex closed sections.

As an example of such a vehicle structural member having a closed section, there is a bumper beam (or a back beam) having at least two closed sections that is used in a bumper beam device, which is fixed by a stay and greatly affects the impact absorption performance of the vehicle.

The problem of the uneven cooling effect on the circular section or closed section which is caused in the hot-stamping method makes it difficult for the bumper beam to have uniform strength. Therefore, to provide the satisfactory strength, a separate post heat treatment process including a process of heating and quenching is required. Such a post heat treatment process reduces the advantages of the hot-stamping method.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various embodiments of the present invention are directed to providing a three-dimensional cooling type hot-stamping method and system in which the internal and external portions of a closed-section structural member can be cooled by cooling water spray operations which are performed internally and on side surfaces of the mold, whereby the strength of the structural member can be uniformly enhanced, and particularly, the flow of cooling water sprayed into the closed-section structural member can be controlled wherein uniformity of the cooling effect on a complex closed-section structure can be enhanced, and to a vehicle structural member manufactured by the hot-stamping method and system.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with various exemplary embodiments of the present invention, there is provided a hot-stamping method, including: a three-dimensional cooling mode in which, when a closed-section product placed in an upper mold and a lower mold that are coupled each other is heat-treated under control of a controller, an external cooling water direct spraying operation of directly spraying cooling water onto an external portion of the closed-section product is performed and, simultaneously, an internal cooling water direct spraying operation of directly spraying cooling water into an internal of the closed-section product is performed.

The three-dimensional cooling mode may include: (A) coupling the upper mold with the lower mold after a product to be formed has been placed on a die of the lower mold, and roll-forming the product using the upper mold and manufacturing the product into the closed-section product; (B) performing an external cooling water direct spraying operation of directly spraying the cooling water onto the external portion of the closed-section portion by an upper-mold direct spray device provided in the upper mold after the upper mold and the lower mold have been coupled with each other; (C) performing an external cooling water direct spraying operation of directly spraying the cooling water onto the external portion of the closed-section product by a lower-mold direct spray device provided in the lower mold after the upper mold and the lower mold have been coupled with each other; (D) performing an internal cooling water direct spraying operation of directly spraying the cooling water into the internal of the closed-section product by any one of a left closed-section cooling water spray device disposed on a left side of the upper and lower molds and a right closed-section cooling water spray device disposed on a right side thereof, after the upper mold and the lower mold have been coupled with each other; and (E) continuing the external cooling water direct spraying operations and the internal cooling water direct spraying operation during a time of the heat treatment.

The upper-mold direct spray device may be disposed over the closed-section product and directly spray the cooling water toward the external portion of the closed-section product, and the lower-mold direct spray device may be disposed below the closed-section product and directly spray the cooling water toward the external portion of the closed-section product.

The internal cooling water direct spray operation may form a closed cooling water circulation flow in the closed-section product, wherein the closed cooling water circulation flow may be formed wherein the cooling water is drawn from the left closed-section cooling water spray device, flows along the internal of the closed-section product, is blocked by the right closed-section cooling water spray device, flows in a reverse direction along the internal of the closed-section product, and is discharged through the left closed-section cooling water spray device.

The internal cooling water direct spray operation may form a partial closed cooling water circulation flow in the closed-section product, wherein the partial closed cooling water circulation flow may be formed wherein the cooling water is drawn from the left closed-section cooling water spray device and flows along the internal of the closed-section product, and when the cooling water reaches the right closed-section cooling water spray device, a unblocked cooling water flow and a blocked cooling water flow are formed by the right closed-section cooling water spray device, and the unblocked cooling water is discharged through the right closed-section cooling water spray device while the blocked cooling water remains in the closed-section product.

In an embodiment, the hot-stamping method may include a three-dimensional cooling mode in which, when a closed-section product placed in an upper mold and a lower mold that are coupled each other is heat-treated under control of a controller, an external cooling water direct spraying operation of directly spraying cooling water onto an external portion of the closed-section product is performed, and an internal cooling water direct spraying operation of directly spraying cooling water into an internal of the closed-section product in a simultaneous, sequential, and circulating manner under time control is performed.

In accordance with various exemplary embodiments of the present invention, there is provided a hot-stamping system including a hot-stamping device configured to form a closed-section product and thermally treat the closed-section product. The hot-stamping device may include a vertical direct spray device divided into a lower-mold direct spray device and an upper-mold direct spray device that are respectively disposed in a lower mold on which a product to be formed is placed, and an upper mold which is coupled with the lower mold to form the product to be formed into a closed-section product, the lower and upper-mold direct spray devices being configured to spray cooling water onto the closed-section product; a horizontal direct spray device divided into a left closed-section cooling water spray device and a right closed-section cooling water spray device that are respectively disposed on left and right side surfaces of the upper and lower molds and are configured to spray cooling water onto the closed-section product; a controller configured to control the operation of spraying the cooling water from the vertical direct spray device and the horizontal direct spray device; and a cooling water tank configured to store the cooling water.

The horizontal direct spray device may include a block body with left and right cooling water passages formed in the block body, and left and right valve connectors configured to respectively open or close the left and right cooling water passages.

The horizontal direct spray device may include: an upper cooling water block including a block body with left and right cooling water passages formed in the block body, and left and right valve connectors configured to respectively open or close the left and right cooling water passages; and a lower cooling water block including a block body with left and right cooling water passages formed in the block body, and left and right valve connectors configured to respectively open or close the left and right cooling water passages. The upper cooling water block and the lower cooling water block may be vertically stacked with each other.

In accordance with various exemplary embodiments of the present invention, there is provided a vehicle structural member manufactured as a bumper beam having impact absorption performance with a strength deviation of 1.2% or less through a heat treatment operation of simultaneously spraying cooling water onto the internal and external portions of the closed-section product placed in the upper and lower molds coupled with each other.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
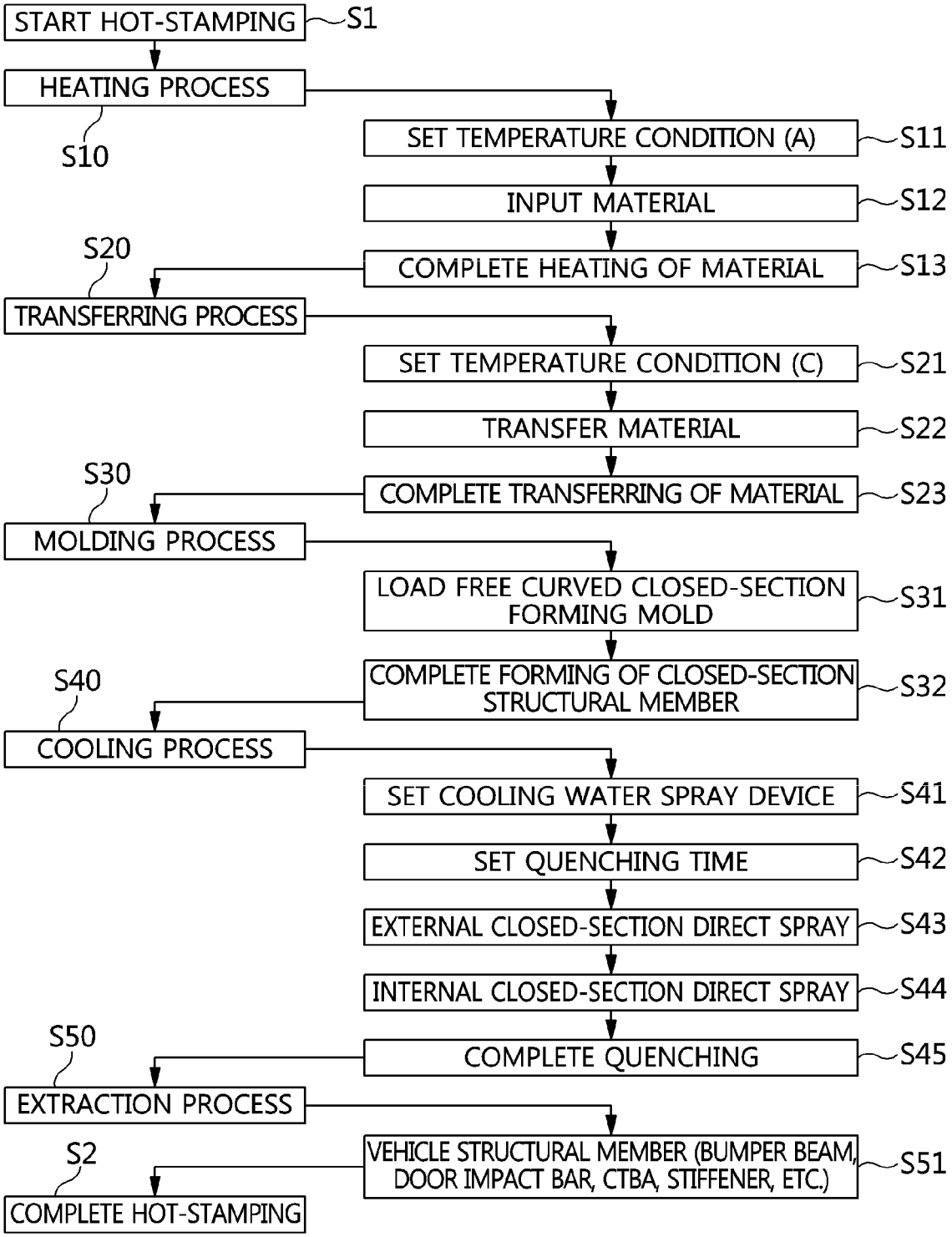
FIG. 1 is a flowchart showing a three-dimensional cooling type hot-stamping method according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will be understood that when an element including a layer, a film, a region, or a plate is referred to as being "above" another element, it can be "immediately above" the other element or intervening elements may also be present.

In contrast, when an element is referred to as being "immediately above" another element, there are no intervening elements present. In addition, it will be understood that when an element is referred to as being "entirely" formed on another element, it can be formed on the entire surface (or whole surface) of the other element or cannot be formed at a portion of the edge thereof.

Referring to FIG. 1, in a three-dimensional hot-stamping method, a cooling operation S40 using cooling water is performed in a three-dimensional mode, including a closed-section external direct spray operation S43, a closed-section internal direct spray operation S44 and a quenching complete operation S45. Therefore, the internal direct spray operation, which has not been embodied in the conventional method that can embody only the external direct spray operation for open section products due to characteristics of a mold structure, is possible without changing the internal structure of the mold. Consequently, the internal and external surfaces of a closed-section product can also be uniformly cooled by the hot-stamping method, whereby the strength of the product can be uniformly enhanced.

In the three-dimensional mode employed in the three-dimensional cooling type hot-stamping method, after a closed-section product disposed in an upper mold and a lower mold that have been coupled to each other has been heat-treated under the control of a controller, cooling water is directly sprayed onto the external surface of the closed-section product, and cooling water is directly sprayed into the internal of the closed-section product in a simultaneous, sequential(or successive) and/or circulating manner under time control. Therefore, the internal and external surfaces of the closed-section product can be more uniformly cooled, whereby the strength of the product can be more uniformly enhanced.

FIG. 2, FIG. 3, FIG. 4, and FIG. 5 illustrate a detailed configuration of a hot-stamping system 1 and a hot-stamping device 10 that is a component of the hot-stamping system 1. Hereinafter an internal of the closed-section product has the same meaning as an internal volume of the closed-section product or an internal volume and surface(s) within the product being formed. Left and right sides of the upper and lower molds and left and right closed-section cooling water spray devices have the same meaning as one and opposite sides of the upper and lower molds and first and second closed-section cooling water spray devices, respectively.

Figure 2:
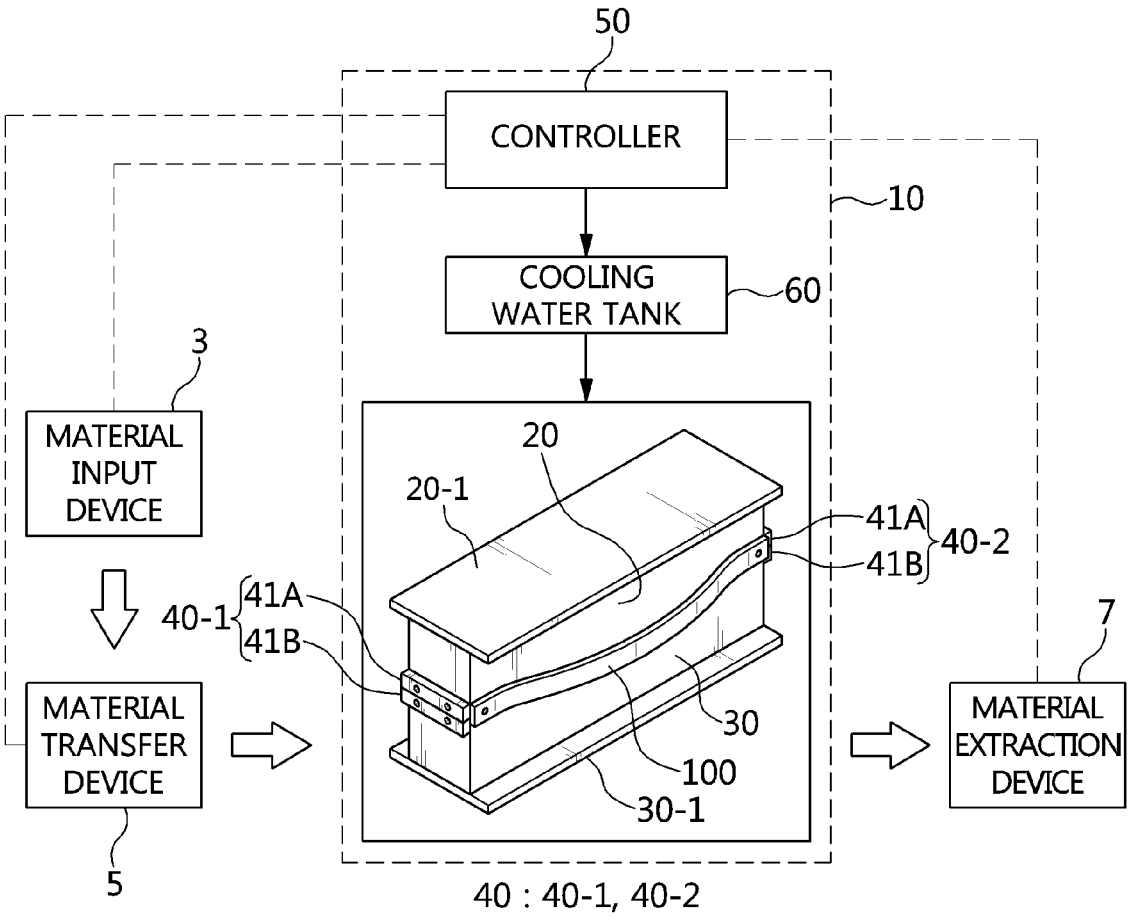
FIG. 2 is a diagram illustrating the configuration of a hot-stamping system for embodying the three-dimensional cooling type hot-stamping method according to an exemplary embodiment of the present invention.

Referring to FIG. 2, the hot-stamping system 1 includes a material input device 3, a material transfer device 5, a material extraction device 7, and the hot-stamping device 10. The hot-stamping system 1 further includes a controller 50 configured for controlling the hot-stamping system 1, and a cooling water tank 60 for supplying cooling water to the hot stamping device 10.

In detail, the material input device 3 manufactures a product formed by shape-machining a material including a plate, a pipe, etc. through heating and pressing (or punching) processes, and then supplies the formed product to the material transfer device 5. The material transfer device 5 transfers the formed product to the hot stamping device 10. The material extraction device 7 extracts a machined product (e.g., a CTBA for a chassis includes a bumper beam, a door impact bar, a design stiffener, and a structural member or collision member) that has been machined by the hot-stamping device 10 through roll-forming and quenching processes. The material input device 3, the material transfer device 5, and the material extraction device 7 are typical devices of the hot-stamping system 1.

In detail, the hot-stamping device 10 is configured with an upper mold 20, a lower mold 30, and a closed-section cooling water spray device 40.

For example, the upper mold 20 includes a punch, a die and an upper-mold direct spray device 20-1 to form a formed product and complete a machined product. The upper-mold direct spray device 20-1 performs a closed-section external direct spray operation of spraying cooling water of the cooling water tank 60 downward from the upper mold 20 to the lower mold 30 under the control of the controller 50. The lower mold 30 includes a punch, a die and a lower-mold direct spray device 30-1 to form the formed product and complete the machined product. The lower-mold direct spray device 30-1 performs a closed-section external direct spray operation of spraying cooling water of the cooling water tank 60 upward from the lower mold 30 to the upper mold 20 under the control of the controller 50. Therefore, each of the upper/lower-mold direct spray devices 20-1 and 30-1 is defined as a vertical direct spray device. The configurations and cooling water spray control methods of the upper/lower-mold direct spray devices 20-1 and 30-1 are the same as those of a typical upper/lower-mold direct spray device for the closed-section external direct spray operation.

For example, the closed-section cooling water spray device 40 is formed of a left closed-section cooling water spray device 40-1 which is disposed on left side portions of the upper and lower molds 20 and 30, and a right closed-section cooling water spray device 40-2 which is disposed on the right side portions of the upper and lower molds 20 and 30. Therefore, each of the left and right closed-section cooling water spray devices 40-1 and 40-2 may be defined as a horizontal direct spray device. For the present case, each of the left and right closed-section cooling water spray devices 40-1 and 40-2 is formed of a cooling water block through which cooling water passes. The cooling water block includes an upper cooling water block 41A or a lower cooling water block 41B, or a pair of upper and lower cooling water blocks 41A and 41B.

In detail, to manufacture a product through the hot-stamping method, the controller 50 controls the material input device 3, the material transfer device 5, the material extraction device 7, and the hot-stamping device 10 through a logic of the three-dimensional hot-stamping method. The controller 50 controls the upper- and lower-mold direct spray devices 20-1 and 30-1 wherein cooling water is directly sprayed from the cooling water tank 60 onto the external surface of the closed-section product. Simultaneously, the controller 50 controls the left and right closed-section cooling water spray devices 40-1 and 40-2 wherein cooling water is directly sprayed from the cooling water tank 60 into the internal of the closed-section product. The cooling water tank 60 stores cooling water to be directly sprayed onto the external surface of the closed-section product or into the internal of the closed-section product.

Figure 3:
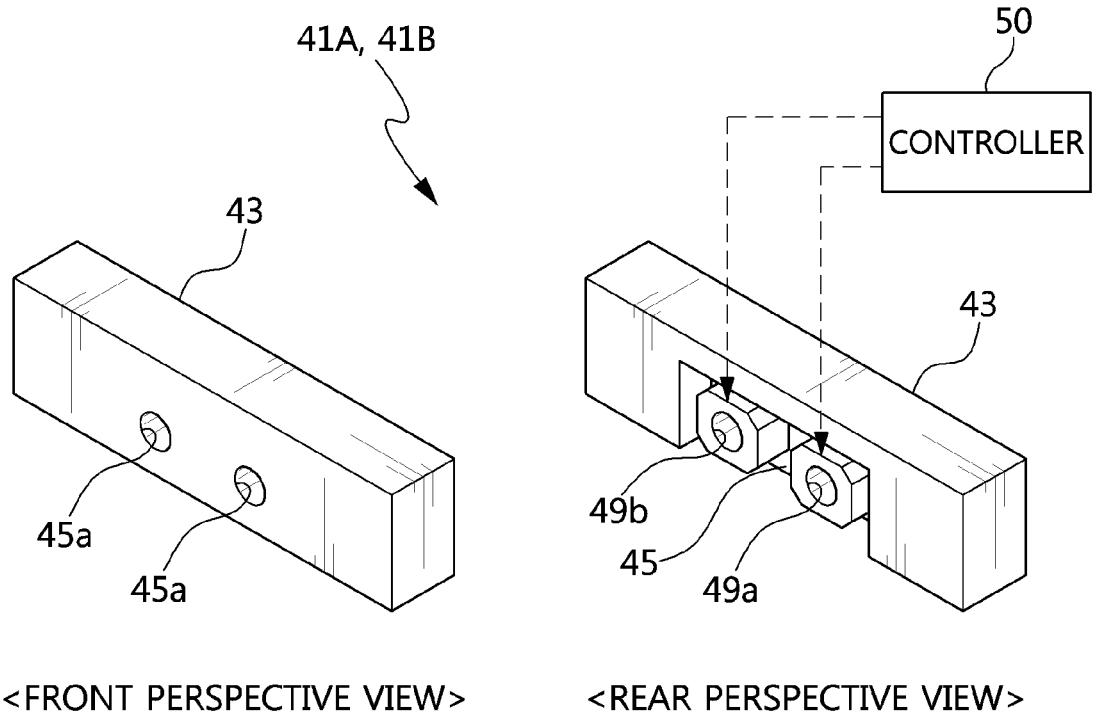
FIG. 3 is a diagram illustrating the configuration of a closed-section cooling water spray device according to an exemplary embodiment of the present invention.

Referring to FIG. 3, there is illustrated an example in which the cooling water block is formed of the upper cooling water block 41A and the lower cooling water block 41B which are formed in pair and have the same configuration. Therefore, the terms "upper cooling water block 41A" and "lower cooling water block 41B" are terms used to distinguish the same components from each other according to their position.

For example, the upper cooling water block 41A includes a block body 43, cooling water passages 45*a* and 45*b*, a connector disposition surface 45, and valve connectors 49*a* and 49*b*. The block body 43 is formed in a rectangular body shape and has therein the cooling water passages 45*a* and 45*b*, the connector disposition surface 45, and valve connectors 49*a* and 49*b*. The cooling water passages 45*a* and 45*b* are divided into left and right cooling water passages 45*a* and 45*b* and are formed passing through the block body 43 at positions distanced apart from each other. The connector disposition surface 45 has therein a region in which the valve connectors 49*a* and 49*b* are disposed. The connector disposition surface 45 is formed in a rectangular shape by cutting out a surface of the block body 43 within a range corresponding to the size of the block body 43. The valve connectors 49*a* and 49*b* are divided into left and right valve connectors 49*a* and 49*b*. The left valve connector 49*a* is disposed on the left cooling water passage 45*a*, and the right valve connector 49*b* is disposed on the right cooling water passage 45*b*. The left and right valve connectors 49*a* and 49*b* of the upper and lower cooling water blocks 41A and 41B are turned on or off by the controller 50.

Therefore, the lower cooling water block 41B is also formed of a block body 43, cooling water passages 45*a* and 45*b*, a connector disposition surface 45, and valve connectors 49*a* and 49*b*, and has the same configuration as that of the upper cooling water block 41A that includes the block body 43, the cooling water passages 45*a* and 45*b* divided into the left and right cooling water passages 45*a* and 45*b*, the connector disposition surface 45, and the valve connectors 49*a* and 49*b* divided into the left and right valve connectors 49*a* and 49*b*.

Figure 4:
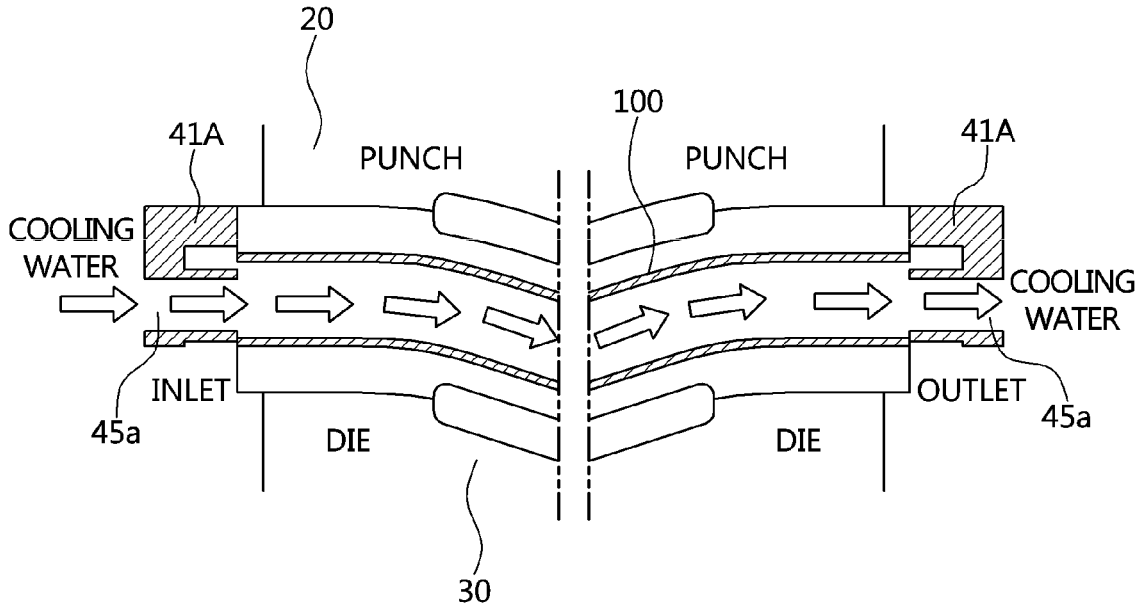
FIG. 4 is a diagram showing a single arrangement structure of the closed-section cooling water spray device according to an exemplary embodiment of the present invention.

Referring to FIG. 4, there is illustrated the layout of the left and right closed-section cooling water spray devices 40-1 and 40-2. In the present case, each of the left and right closed-section cooling water spray devices 40-1 and 40-2 is formed of the upper cooling water block 41A. That is, the left closed-section cooling water spray device 40-1 that is disposed on the left side portions of the upper and lower molds 20 and 30, and the right closed-section cooling water spray device 40-2 that is disposed on the right side portions of the upper and lower molds 20 and 30, each is formed of only the upper cooling water block 41A. As a result, cooling water supplied to the upper cooling water block 41A forms a cooling water circulation flow, along which the cooling water is discharged from the cooling water tank 60, drawn into the left and right cooling water passages 45*a* and 45*b* formed in the upper cooling water block 41A of the left closed-section cooling water spray device 40-1, discharged to the left and right cooling water passages 45*a* and 45*b* formed in the upper cooling water block 41A of the right closed-section cooling water spray device 40-2, and then returned to the cooling water tank 60.

Figure 5:
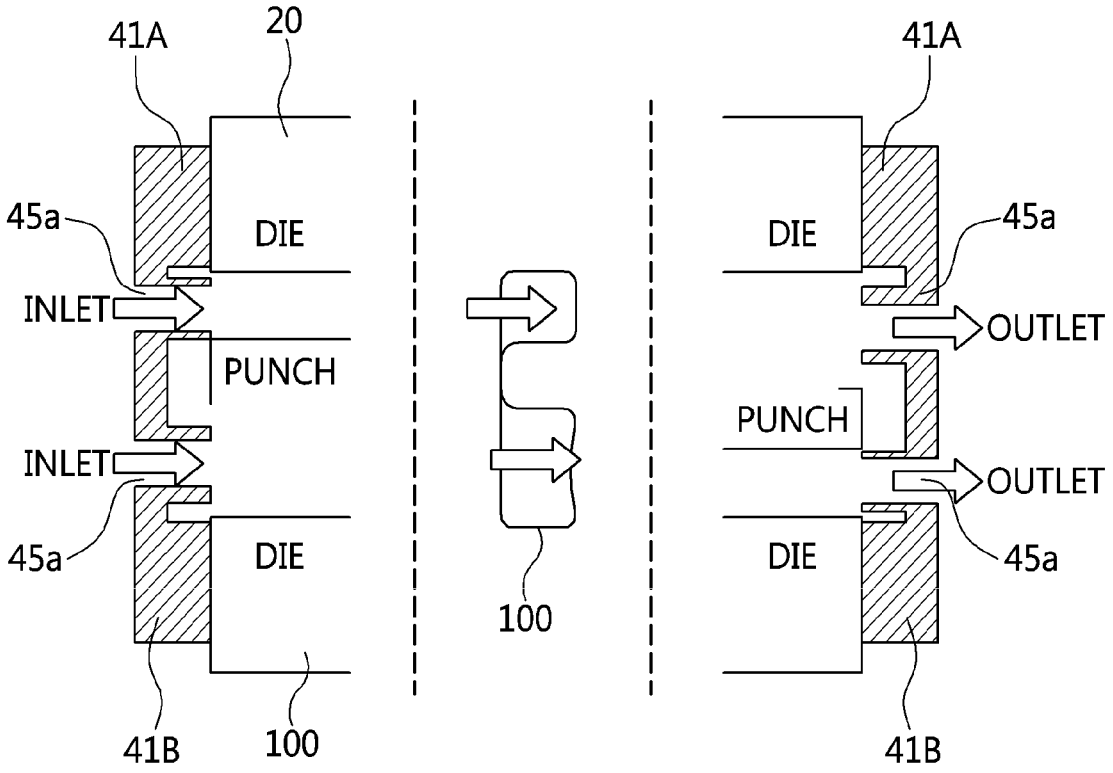
FIG. 5 is a diagram showing a double arrangement structure of the closed-section cooling water spray device according to an exemplary embodiment of the present invention.

Referring to FIG. 5, there is illustrated an appropriate layout of the left and right closed-section cooling water spray devices 40-1 and 40-2. In the present regard, each of the left and right closed-section cooling water spray devices 40-1 and 40-2 is formed of a combination of the upper cooling water block 41A and the lower cooling water block 41B. That is, the left closed-section cooling water spray device 40-1 formed of a combination of the upper and lower cooling water blocks 41A and 41B is disposed on the left side portions of the upper and lower molds 20 and 30, and the right closed-section cooling water spray device 40-2 formed of a combination of the upper and lower cooling water blocks 41A and 41B is disposed on the right side portions of the upper and lower molds 20 and 30. As a result, cooling water supplied to the upper and lower cooling water blocks 41A and 41B forms a cooling water circulation flow, along which the cooling water is discharged from the cooling water tank 60, drawn into the left and right cooling water passages 45*a* and 45*b* formed in the upper and lower cooling water blocks 41A and 41B of the left closed-section cooling water spray device 40-1, discharged to the left and right cooling water passages 45*a* and 45*b* formed in the upper and lower cooling water blocks 41A and 41B of the right closed-section cooling water spray device 40-2, and then returned to the cooling water tank 60.

Therefore, the appropriate layout of the left and right closed-section cooling water spray devices 40-1 and 40-2 makes various control operations in the cooling water circulation flow possible.

Hereinafter, the three-dimensional cooling type hot-stamping method of FIG. 1 will be described in detail with reference to FIG. 2, FIG. 3, FIG. 4, FIG. 5, FIG. 6, FIG. 7, and FIG. 8. A main control agent is the controller 50 for controlling the operation of the hot-stamping system 1 and the cooling water circulation of the cooling water tank 60. A control object is the cooling water of the hot-stamping system 1 or the hot-stamping device 10 for quenching. Furthermore, a bumper beam 100 will be referred to as an example of a manufactured product. Furthermore, the term "material (plate or pipe)" refers to a pre-machined state. The term "formed product" refers to a state in which the material has been handled by the material input device 3 and the material transfer device 5. The term "machined product" refers to a state in which the formed product has been processed by the hot-stamping device 10. The term "completed product" refers to a state in which the machined product has been extracted from the material extraction device 7. Furthermore, the term "completed product" means a vehicle structural member including the bumper beam 100, a door impact bar, a CTBA, a stiffener, and so forth.

The three-dimensional cooling type hot-stamping method is performed under the control of the controller 50, between a hot-stamping start step S1 and a hot-stamping complete step S2, through a heating step S10 which is performed by the material input device 3, a transfer step S20 which is performed by the material transfer device 5, a molding step S30 and a cooling step S40 which are performed by the hot-stamping device 10, and an extraction step S50 which is performed by the material extraction device 7.

The heating step S10 includes a temperature condition setting step (A) S11, a material input step S12, and a material heating completion step (B) S13. In the present case, forming conditions are set at steps "A" and "B". At step "A", a material heating temperature is approximately 950° C. At step "B", the time it takes to complete the forming process after the material has been heated to 950° C. is approximately six minutes. As a result, a material including a plate or pipe is formed into a formed product by the material input device 3 and then supplied to the material transfer device 5.

The transfer step S20 includes a temperature condition setting step (C) S21, a material transfer step S22, and a material transfer completion step (D) S23. In the present regard, transfer conditions are set at steps "C" and "D". At step "C", a formed product heating temperature is 950° C. or less. At step "D", the time it takes to transfer the formed product is approximately seven seconds. As a result, the formed product that has been supplied from the material input device 3 is heated and supplied to the hot-stamping device 10 by the material transfer device 5.

The molding step S30 includes a free-curved closed-section forming mold loading step (E) S31, and a closed-section structural member forming completion step. In the present regard, forming conditions are set at step "E". At step "E", the time it takes to form the formed product supplied from the material transfer device 3 into a machined product by roll-forming is approximately four seconds. As a result, the formed product supplied from the material transfer device 5 is machined into a machined product having a free-curved closed-section by the upper and lower molds 20 and 30. In the present regard, the free curve refers to a curved line formed along the length of the machined product. The present curved line is determined by die structures of the upper and lower molds 20 and 30.

Figure 6:
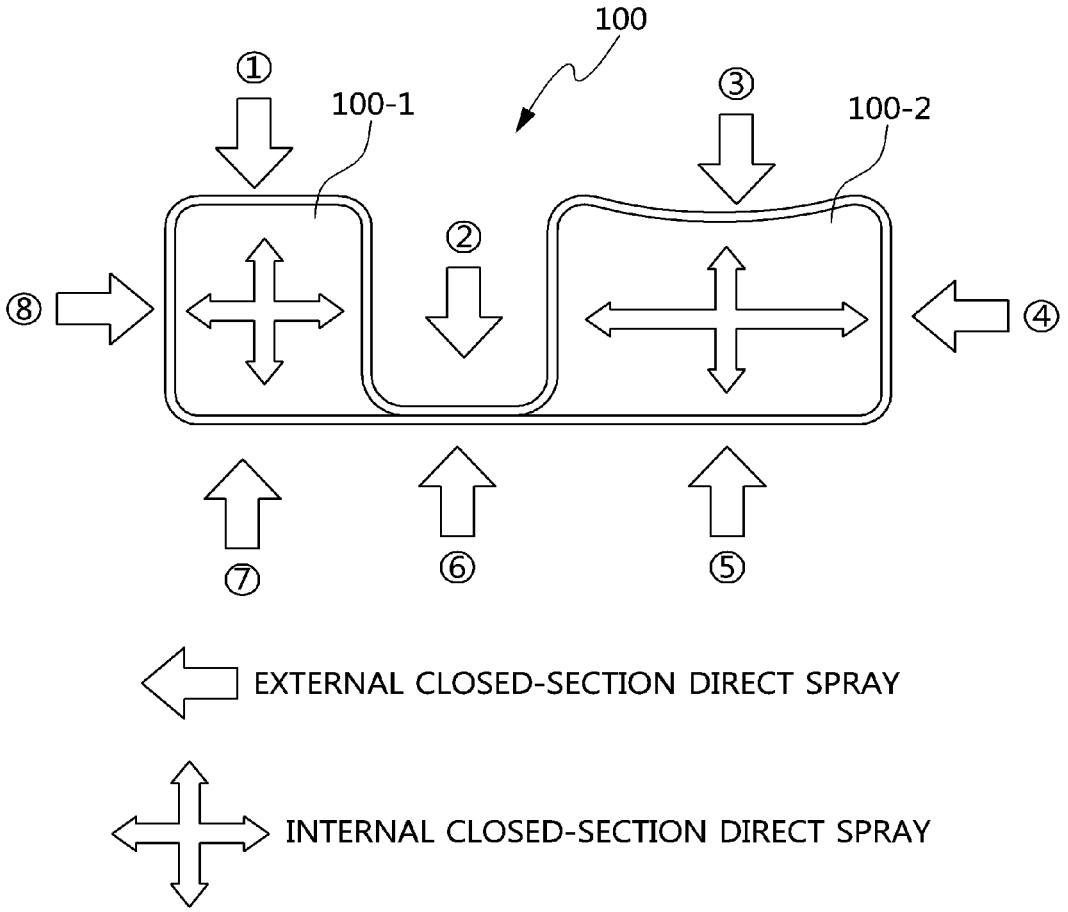
FIG. 6 is a view illustrating heat treatment points by internal and external cooling water direct spray operations performed after a structural member has been formed into a machined product having two closed sections by roll-forming, according to an exemplary embodiment of the present invention.

Referring to FIG. 2, the controller 50 controls the upper mold 20 wherein the formed product supplied from the material transfer device 3 is placed on the die of the lower mold 30 and then the upper mold 20 is coupled with the lower mold 30. Subsequently, the controller 50 controls a punch of the upper mold 20 and roll-forms the formed product for a predetermined time, completing a machined product. Referring to FIG. 6, there is illustrated an example in which the formed product is machined into a bumper beam 100 including a left first closed section 100-1 and a right second closed section 100-2 with an intermediate portion interposed therebetween. The bumper beam 100 needs uniform cooling effect for eight heat treatment points divided into ①, ②, ③, ④, ⑤, ⑥, ⑦ and ⑧ along the entire perimeter thereof The present case can be realized by a closed-section external direct spray operation using the upper- and lower-mold direct spray devices 20-1 and 30-1 and an closed-section internal direct spray operation using the closed-section cooling water spray device 40.

The cooling step S40 includes a cooling water spray device setting step S41, a quenching time setting step (F) S42, a closed-section external direct spray step S43, a closed-section internal direct spray step S44, and a quenching complete step S45. In the present regard, heat treatment conditions are set at step "E". At step "E", the quenching time is approximately fifteen seconds. In an embodiment, the cooling water spray device setting operation includes an operation of coupling the cooling water tank 60 both with the upper- and lower-mold direct spray devices 20-1 and 30-1 for the closed-section external direct spray operation and with the left and right closed-section cooling water spray devices 40-1 and 40-2 for the closed-section internal direct spray operation, and an operation of on/off-controlling valve connectors 49*a* and 49*b* that are respectively provided on the upper/lower cooling water blocks 41A and 41B for closed cooling water circulation flow or partial closed cooling water circulation flow in the closed-section internal direct spray operation. Therefore, the cooling water spray device setting step may be completed in advance before the process starts. As needed, the cooling water spray device setting step may be performed at the molding step. The quenching time may be completed in advance before the process starts, because it is one of the heat treatment conditions. Depending on the size of a machined product and the number of closed sections of the machined product, the quenching time may be changed.

As a result, the formed product may be formed into the bumper beam 100 having first and second closed sections 100-1 and 100-2.

Figure 7:
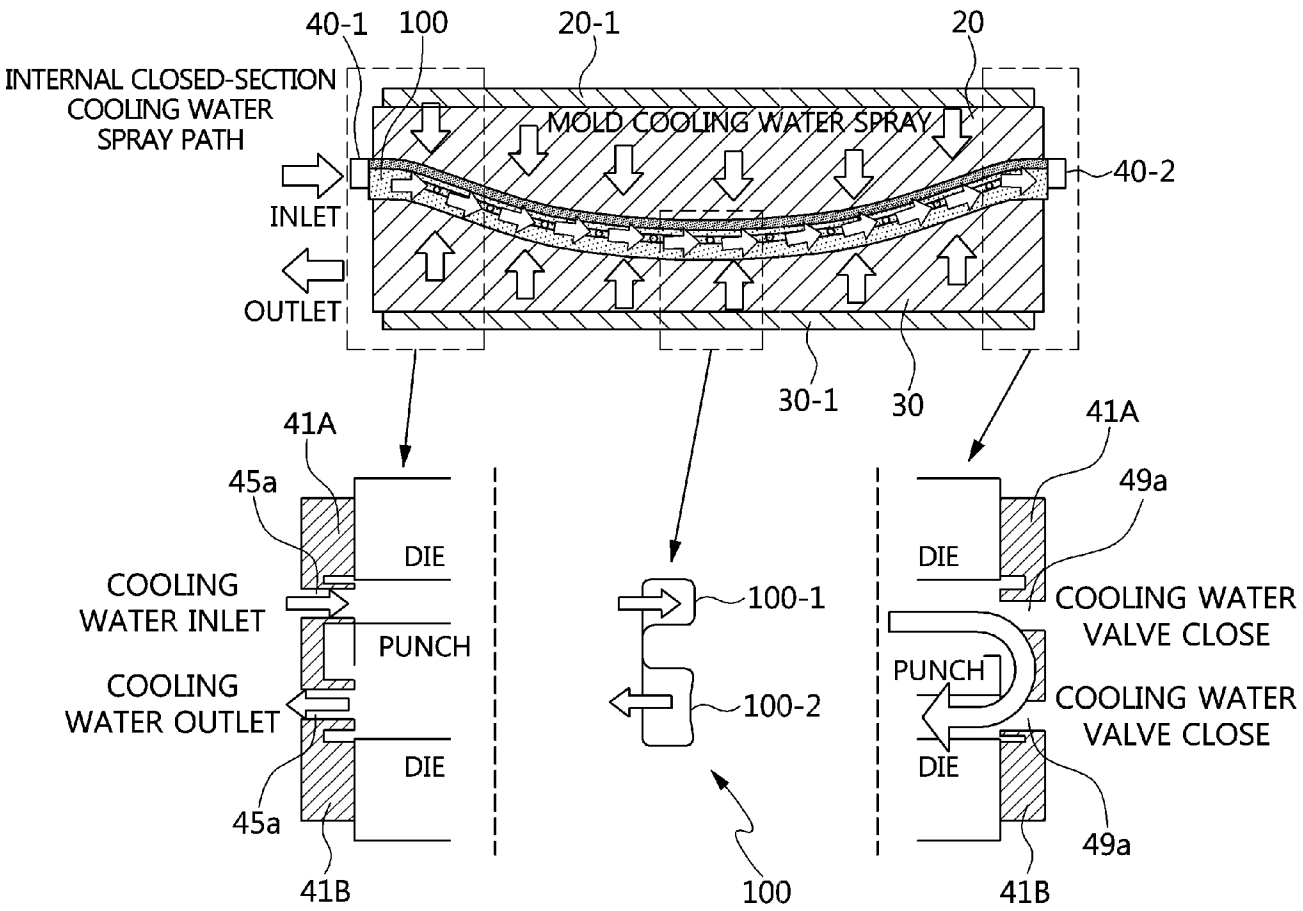
FIG. 7 is a view illustrating a closed circulation flow of cooling water sprayed into a closed-section product when cooling water is directly sprayed onto the internal and external surfaces of the closed-section product having two closed sections, according to an exemplary embodiment of the present invention.

FIG. 7 illustrates a closed-section external direct spray operation, a closed-section internal direct spray operation, and a closed circulation flow of cooling water sprayed through the closed-section internal direct spray operation. The cooling water in the cooling water tank 60 is directly sprayed from the upper/lower-mold direct spray devices 20-1 and 30-1 onto the external surface of the bumper beam 100 having the closed-section structure under the control of the controller 50, and is directly sprayed from the left and right closed-section cooling water spray devices 40-1 and 40-2 into the internal of the bumper beam 100 having the closed-section structure under the control of the controller 50, forming a closed cooling water circulation flow.

The closed cooling water circulation flow is as follows. The controller 50 turns on the left and right valve connectors 49*a* and 49*b* provided on the upper and lower cooling water blocks 41A and 41B of the left closed-section cooling water spray device 40-1 and turns off the left and right valve connectors 49*a* and 49*b* provided on the upper and lower cooling water blocks 41A and 41B of the right closed-section cooling water spray device 40-2 wherein cooling water can be supplied to the upper cooling water block 41A of the left closed-section cooling water spray device 40-1. For the present case, a valve disposed on a cooling water line extending to the upper cooling water block 41A among cooling water lines connecting the cooling water tank 60 with the upper and lower cooling water blocks 41A and 41B of the left closed-section cooling water spray device 40-1 is turned on, and a valve disposed on a cooling line extending to the lower cooling water block 41A is turned off.

Cooling water is supplied from the left end portion of the bumper beam 100 into first and second closed sections 100-1 and 100-2 (refer to FIG. 6) of the bumper beam 100 through the upper cooling water block 41A of the upper and lower cooling water blocks 41A and 41B of the left closed-section cooling water spray device 40-1 that closes the left side surfaces of the upper and lower molds 20 and 30 coupled to each other, and then flows toward the right end portion of the bumper beam 100. Thereafter, the cooling water reaches the upper and lower cooling water blocks 41A and 41B of the right closed-section cooling water spray device 40-2 that closes the right side surfaces of the upper and lower molds 20 and 30. However, because the left and right valve connectors 49*a* and 49*b* of the right closed-section cooling water spray device 40-2 are in the turned-off state, the cooling water returns from the right end portion of the bumper beam 100 to the left end portion thereof rather than coming out of the bumper beam 100. Subsequently, the cooling water that has reached the left end portion of the bumper beam 100 is discharged to externally through the lower cooling water block 41B of the upper and lower cooling water blocks 41A and 41B of the left closed-section cooling water spray device 40-1 Thereafter, the controller 60 opens the valve disposed on the cooling water line extending to the lower cooling water block 41B among the cooling water lines connecting the cooling water tank 60 with the upper and lower cooling water blocks 41A and 41B of the left closed-section cooling water spray device 40-1 and returns the discharged cooling water to the cooling water tank 60. The present circulation of the cooling water to the cooling water tank 60 is repeatedly performed during a heat treatment process.

Consequently, uniform cooling effect can be provided for the eight heat treatment points of the bumper beam 100 that are divided into ①, ②, ③, ④, ⑤, ⑥, ⑦ and ⑧, as shown in FIG. 6.

Figure 8:
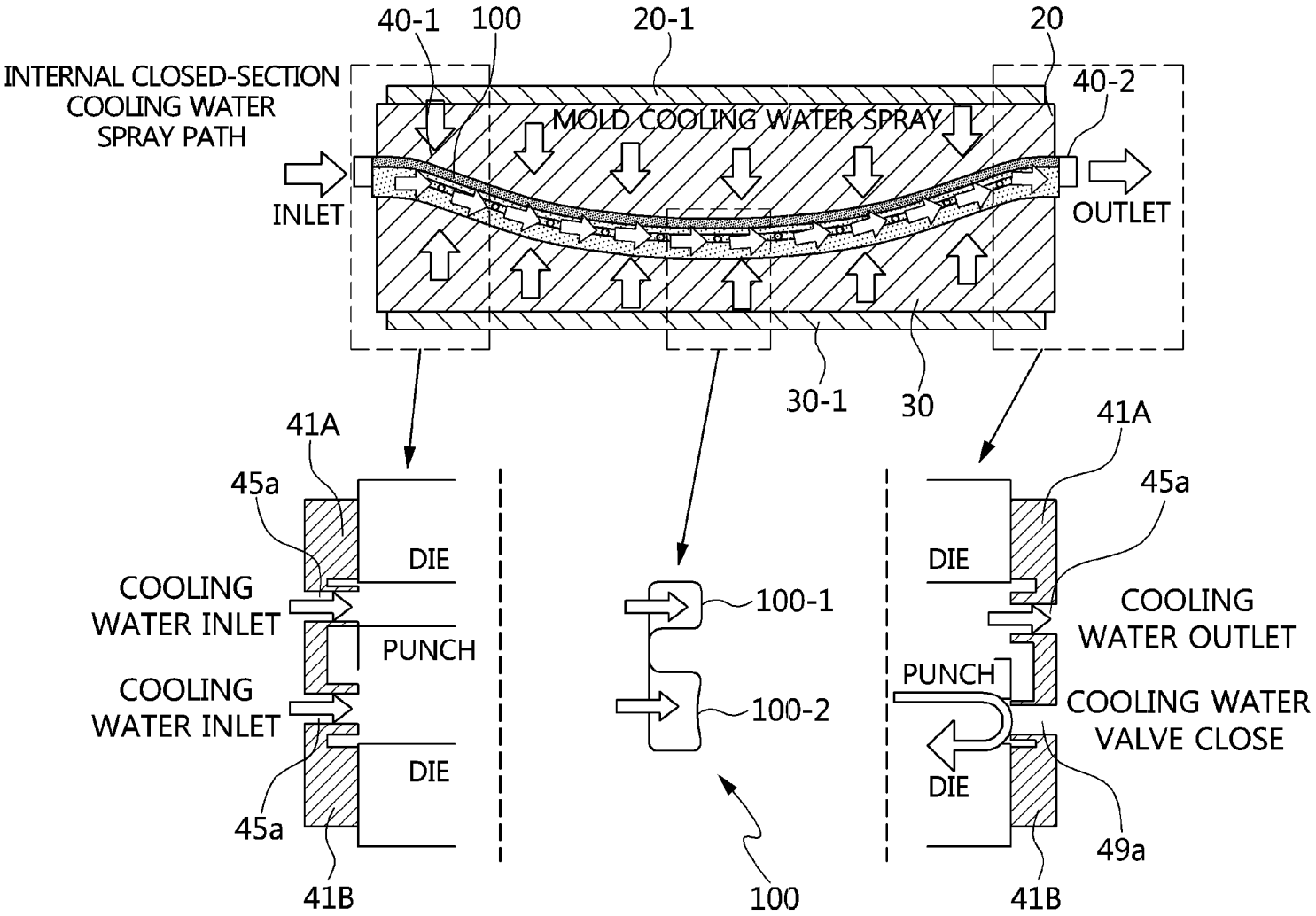
FIG. 8 is a view illustrating a partial closed circulation flow of cooling water sprayed into a closed-section product when cooling water is directly sprayed onto the internal and external surfaces of the closed-section product having two closed sections, according to an exemplary embodiment of the present invention.

FIG. 8 illustrate a closed-section external direct spray operation, a closed-section internal direct spray operation, and a partial closed cooling water circulation flow of cooling water sprayed through the closed-section internal direct spray operation. The cooling water in the cooling water tank 60 is directly sprayed from the upper/lower-mold direct spray devices 20-1 and 30-1 onto the external surface of the bumper beam 100 having the closed-section structure under the control of the controller 50, and is directly sprayed from the left and right close section cooling water spray devices 40-1 and 40-2 into the internal of the bumper beam 100 having the closed-section structure under the control of the controller 50, forming a partial closed cooling water circulation flow.

The partial closed cooling water circulation flow is as follows. The controller 50 turns on the left and right valve connectors 49*a* and 49*b* disposed on the upper and lower cooling water blocks 41A and 41B of the left close section cooling water spray device 40-1, and turns on the left and right valve connectors 49*a* and 49*b* disposed on the upper cooling water block 41A of the upper and lower cooling water blocks 41A and 41B of the right closed-section cooling water spray device 40-2 while turning off the left and right valve connectors 49*a* and 49*b* provided on the lower cooling water block 41B. In the present case, cooling water is supplied to the upper and lower cooling water blocks 41A and 41B of the left closed-section cooling water spray device 40-1. For the present case, the controller 50 opens all valves disposed on cooling water lines connecting the cooling water tank 60 with the upper and lower cooling water blocks 41A and 41B of the left closed-portion cooling water spray device 40-1.

Cooling water is supplied from the left end portion of the bumper beam 100 into first and second closed sections 100-1 and 100-2 (refer to FIG. 6) of the bumper beam 100 through the upper and lower cooling water blocks 41A and 41B of the left closed-section cooling water spray device 40-1 that closes the left side surfaces of the upper and lower molds 20 and 30 coupled to each other, and then flows toward the right end portion of the bumper beam 100. Thereafter, the cooling water reaches the upper and lower cooling water blocks 41A and 41B of the right closed-section cooling water spray device 40-2 that closes the right side surfaces of the upper and lower molds 20 and 30 coupled to each other. However, cooling water is discharged externally through only the turned-on left and right valve connectors 49*a* and 49*b* of the upper cooling water block 41A of the right closed-section cooling water spray device 40-2, and cannot be discharged externally through the turned-off left and right valve connectors 49*a* and 49*b* of the lower cooling water block 41B of the right closed-section cooling water spray device 40-2. The cooling water that is blocked by the turned-off left and right valve connectors 49*a* and 49*b* returns from the right end portion of the bumper beam 100 to the left end portion of the bumper beam 100. As a result, the cooling water that has reached the left end portion of the bumper beam 100 remains, rather than being discharged externally, in the first and second closed-sections 100-1 and 100-2 of the bumper beam 100 because of cooling water that is drawn into the lower cooling water block 41A of the left closed-section cooling water spray device 40-1. Thereafter, the controller 60 opens the valve disposed on the cooling water line extending to the upper cooling water block 41A among the cooling water lines connecting the cooling water tank 60 with the upper and lower cooling water blocks 41A and 41B of the right closed-section cooling water spray device 40-2, and returns the discharged cooling water to the cooling water tank 60. The present circulation of the cooling water to the cooling water tank 60 is repeatedly performed during a heat treatment process.

Consequently, uniform cooling effect can be provided for the eight heat treatment points of the bumper beam 100 that are divided into ①, ②, ③, ④, ⑤, ⑥, ⑦ and ⑧, as shown in FIG. 6. The partial closed cooling water circulation flow forms partial cooling water internal circulation in the first and second closed-sections 100-1 and 100-2 of the bumper beam 100, preventing deterioration of the cooling efficiency which may be caused by a difference in temperature of cooling water between the left and right sides of the bumper beam 100. As a result, even in a comparatively long bumper beam 100 which may have different cooling effects on the left and right end portions thereof, the uniform cooling effect can be provided to the left and right end portions of the bumper beam 100 because of a high flow rate of cooling water.

The extraction step S50 is completed by taking a product completed as a vehicle structural member out of the upper and lower molds 20 and 30, as shown at step S51. For the present step, the controller 50 moves the upper mold 20 away from the lower mold 30 to separate them from each other.

As a result, the bumper beam 100 that has the first and second closed sections 100-1 and 100-2 and has impact absorption performance with strength deviation of 1.2% or less is produced to be used as a vehicle structural member. Substantially, vehicle structural members to which the present invention can be applied may include a chassis CTBA, a door impact bar, a design stiffener, etc.

As described above, in the hot-stamping system according to the present embodiment, heat treatment for the first and second closed sections 100-1 and 100-2 of the bumper beam 100 placed in the upper and lower molds 20 and 30 coupled to each other is performed through the simultaneous internal and external cooling water spray operation. Accordingly, a product having impact absorption performance with a strength deviation of 1.2% or less can be produced. Due to markedly enhanced cooling effect uniformity, a range within which the hot-stamping method can be applied can extend to vehicle structural members having three or more closed sections.

The hot-stamping system according to an exemplary embodiment of the present invention having the above-mentioned configuration and operation realizes the following advantages and effects using the three-dimensional cooling type hot-stamping method.

First, the strength of a closed-section structural member can be uniformly enhanced by only the hot-stamping method. Second, because the uniform enhancement in strength is realized by the uniform cooling effect using a three-dimensional cooling water spray operation, the productivity can be enhanced by the continuity of the hot-stamping method. Third, thanks to three-dimensional cooling water spray flow control, the uniform cooling effect can be also provided to a structural member having a plurality of closed sections, whereby uniform strength enhancement can be achieved. Fourth, because the uniformity in strength can be maintained, a problem of deviation in properties of products produced by the hot-stamping method can be solved. Fifth, because the problem of deviation in properties of products can be solved, the applicability of the hot-stamping method can be markedly increased. Sixth, thanks to an increase in the applicability of the hot-stamping method, enhancement in strength can be also applied to a bumper beam, a door impact bar, a CTBA (Coupled Torsion Beam Axle), a stiffener, etc. which are used as structural members for vehicles.

Furthermore, as the three-dimensional cooling type hot-stamping method according to an exemplary embodiment of the present invention is applied to manufacture of a bumper beam for vehicles, a bumper beam having impact absorption performance with a strength deviation of 1.2% or less can be manufactured.

For convenience in explanation and accurate definition in the appended claims, the terms "upper", "lower", "up", "down", "upwards", "downwards", "internal", "outer", "inside", "outside", "inwardly", "outwardly", "internal", "external", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hot-stamping method, comprising:

performing a three-dimensional cooling mode in which, a closed-section product disposed in an upper mold and a lower mold that are coupled to each other is heat-treated under control of a controller, wherein the three-dimensional cooling mode includes:

coupling the upper mold with the lower mold after a product to be formed has been disposed on a die of the lower mold, and stamping the product using the upper mold and manufacturing the product into the closed-section product;

performing an external cooling water direct spraying operation of directly spraying a cooling water onto an external portion of the closed-section product by an upper-mold direct spray device disposed in the upper mold after the upper mold and the lower mold have been coupled with each other;

performing the external cooling water direct spraying operation of directly spraying the cooling water onto the external portion of the closed-section product by a lower-mold direct spray device disposed in the lower mold after the upper mold and the lower mold have been coupled with each other;

performing an internal cooling water direct spraying operation of directly spraying the cooling water into an internal volume of the closed-section product by one of a first closed-section cooling water spray device disposed on a one side of the upper and lower molds and a second closed-section cooling water spray device provided on an opposite side thereof, after the upper mold and the lower mold have been coupled with each other; and continuing the external cooling water direct spraying operation and the internal cooling water direct spraying operation during a time of a heat treatment, wherein the internal cooling water direct spraying operation forms a partial closed cooling water circulation flow in the closed-section product, wherein the partial closed cooling water circulation flow is formed such that the cooling water is drawn from the first closed-section cooling water spray device and flows along the internal volume of the closed-section product, and when the cooling water reaches the second closed-section cooling water spray device, a unblocked cooling water flow and a blocked cooling water flow are formed by the second closed-section cooling water spray device, and the unblocked cooling water flow is discharged through the second closed-section cooling water spray device while the blocked cooling water flow remains in the closed-section product, and wherein the blocked cooling water flow of the cooling water that is blocked by valve connectors of a lower cooling water block of the second closed-section cooling water spray device returns from an opposite side end portion of the closed-section product to a one side end portion of the closed-section product, and the blocked cooling water flow remains, rather than being discharged externally, in closed-sections of the closed-section product because of cooling water that is drawn into a lower cooling water block of the first closed-section cooling water spray device, and wherein a valve connector of an upper cooling water block of the second closed-section cooling water spray device is turned on in order for the unblocked cooling water flow to be discharged through the second closed-section cooling water spray device, the upper cooling water block being located above the lower cooling water block.

2. The hot-stamping method of claim 1, wherein performing the internal cooling water direct spraying operation for the internal volume of the closed-section product is in a simultaneous, sequential, or circulating manner in relation to the external cooling water direct spraying operation.

3. The hot-stamping method of claim 1, wherein the time of the heat treatment is fifteen seconds.

4. The hot-stamping method of claim 1, wherein the upper-mold direct spray device is disposed over the closed-section product and directly sprays the cooling water toward the external portion of the closed-section product, and the lower-mold direct spray device is disposed below the closed-section product and directly sprays the cooling water toward the external portion of the closed-section product.

5. The hot-stamping method of claim 1, wherein the internal cooling water direct spray operation forms a closed cooling water circulation flow in the closed-section product, wherein the closed cooling water circulation flow is formed such that the cooling water is drawn from the first closed-section cooling water spray device, flows along the internal volume of the closed-section product, is blocked by the second closed-section cooling water spray device, flows into a reverse direction along the internal volume of the closed-section product, and is discharged through the first closed-section cooling water spray device.

6. The hot-stamping method of claim 1, wherein the product to be formed is heated at 950° C. for six minutes and then placed on the die of the lower mold.

7. A vehicle structural member manufactured as a bumper beam by the hot-stamping method according to claim 1.

* * * * *